US005331685A

United States Patent [19]

Belgard

[11] Patent Number: 5,331,685

[45] Date of Patent: Jul. 26, 1994

[54] JUMPSUIT WITH LATERAL BREAST ZIPPERS

[76] Inventor: Truly M. Belgard, P.O. Box 470714, Fort Worth, Tex. 76147

[21] Appl. No.: 29,396

[22] Filed: Mar. 10, 1993

[51] Int. Cl.[5] ..... A41D 1/06

[52] U.S. Cl. ..... 2/79; 2/69; 2/114; 2/104

[58] Field of Search ..... 2/79, 69, 70, 75, 80, 2/114, 104, DIG. 1, DIG. 7

[56] References Cited

U.S. PATENT DOCUMENTS

| | | | |
|---|---|---|---|
| 697,576 | 4/1902 | Walter et al. | 2/104 |
| 1,321,597 | 11/1919 | Colvin . | |
| 1,326,536 | 12/1919 | Slattery . | |
| 1,386,950 | 8/1921 | Rifkin . | |
| 1,479,854 | 1/1924 | Heller | 2/79 |
| 1,804,930 | 5/1931 | Head et al. . | |
| 2,585,840 | 2/1952 | Reynolds | 2/79 |
| 5,097,536 | 3/1992 | Cohen | 2/DIG. 7 |

OTHER PUBLICATIONS

Gershman, M. D., Maurice; "Self-Adhering Nylon Tapes" Journal of the American Medical Assoc., vol. 68, No. 7, p. 930.

*Primary Examiner*—Clifford D. Crowder
*Assistant Examiner*—Gloria Hale
*Attorney, Agent, or Firm*—Jacobson, Price, Holman & Stern

[57] ABSTRACT

A unitary garment for enclosing the torso and at least the upper arms and legs of the wearer is provided and has a crotch portion, a collar portion, shoulder portions on opposite sides of the collar portion, sleeve portions projecting outwardly and downwardly from the shoulder portions and a front portion extending between the crotch and shoulder portions and interconnecting the sleeve, shoulder and leg portions. The front portion defines a vertical central opening therein having upper and lower ends the opening upwardly through the collar portion and terminating downwardly adjacent the crotch portion. The sleeve portions are joined to the front portion along vertical opposite sides zones of the front portion extending downwardly from the shoulder portions to approximately the mid-height chest level of the front portions. Opposite side, horizontal openings extend from the central opening a the mid-height chest level of the front portion of the garment outwardly to points closely adjacent the corresponding aforementioned zones and spaced generally two-thirds downwardly therealong from the upper extremities thereof the horizontal openings including slide fastener structure for closing the horizontal openings and incorporating fastener elements slidable outwardly and inwardly along the horizontal openings to open and close, respectively, the horizontal openings.

4 Claims, 2 Drawing Sheets

JUMPSUIT WITH LATERAL BREAST ZIPPERS

BACKGROUND OF THE INVENTION

1. Field of the Invention

This invention relates to a jumpsuit or coverall including a removably closable vertical center front opening extending from the collar down to the crotch portion. The jumpsuit or coverall further includes waist ciching fastener means in the area of the center front opening disposed at waist level. Further, the upper opposite side breast areas of the jumpsuit or coverall are provided with horizontal openings extending from the center front opening, (immediately below the lower extremity of the collar) outwardly to the outer limits of the chest areas of the front of the jumpsuit or coverall to which the opposite arms sleeves are secured, the outer limits of the horizontal openings being disposed at locations spaced substantially two thirds the vertical extent of the sleeve seams from the upper limits thereof at the outer extremities of the shoulders of the jumpsuit or coverall. Each of the horizontal openings is provided with a slide fastener including a closure element which opens and closes the corresponding horizontal opening as the element is slid toward and away from, respectively, the corresponding sleeve seam.

2. Description of Related Art

Various different forms of jumpsuit or coverall type garments constructed to facilitate ease in adornment and removal thereof heretofore have been provided such as those disclosed in U.S. Pat. Nos. 1,321,597, 1,326,536, 1,386,950, 1,804,930 and 2,585,840. However, these previously known forms of jumpsuits and/or coveralls do not include the overall combination of structural features of the instant invention.

SUMMARY OF THE INVENTION

The jumpsuit and/or coverall of the instant invention includes the usual center opening extending downward from the collar to the crotch area and with a slide fastener being provided for closing the central opening downward from a point about mid-chest height toward the crotch area of the jumpsuit or coverall. In addition, the opposite upper chest area portions of the jumpsuit and/or coverall include substantially horizontal openings extending from the central opening at a point spaced slightly above the aforementioned slide fastener outwardly toward points immediately adjacent the corresponding jumpsuit and/or coverall sleeve with the outer ends of the openings terminating at points spaced closely adjacent the corresponding sleeve seams and disposed generally two thirds downwardly therealong from the upper limits of the sleeve seams. The horizontal openings are equipped with slide fastener structure for releaseably closing the horizontal openings and including slide elements moveable inwardly and outwardly toward and away from the center opening to close and open, respectively, the horizontal openings, the adjacent ends of the horizontal openings being spaced slightly above the upper extremity of the first mentioned slide fastener and the jumpsuit and/or coverall including a point fastener for removably closing the central opening intermediate the upper end of the first mentioned slide fastener and the adjacent ends of the horizontal openings.

The main object of this invention is to provide a jumpsuit and/or coverall which may be more readily removed and, more specifically, readily removed by arthritic persons.

Another object of this invention is to provide a jumpsuit and/or coverall which may be more readily donned by arthritic persons.

Still another object of this invention is to provide a jumpsuit and/or coverall which is considerably more easily donned and removed over and from over, respectively, heavy clothing during cool weather.

Still another important object of this invention is to provide a jumpsuit and/or coverall constructed in a manner enabling the portions thereof above the waist to be more readily removed and donned while in a seated position within a seat having an upright A final object of this invention to be specifically enumerated herein to provide a jumpsuit and/or coverall in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof wherein like numerals refer to like parts throughout.

DESCRIPTION OF THE PREFERRED EMBODIMENT

Figure 2:
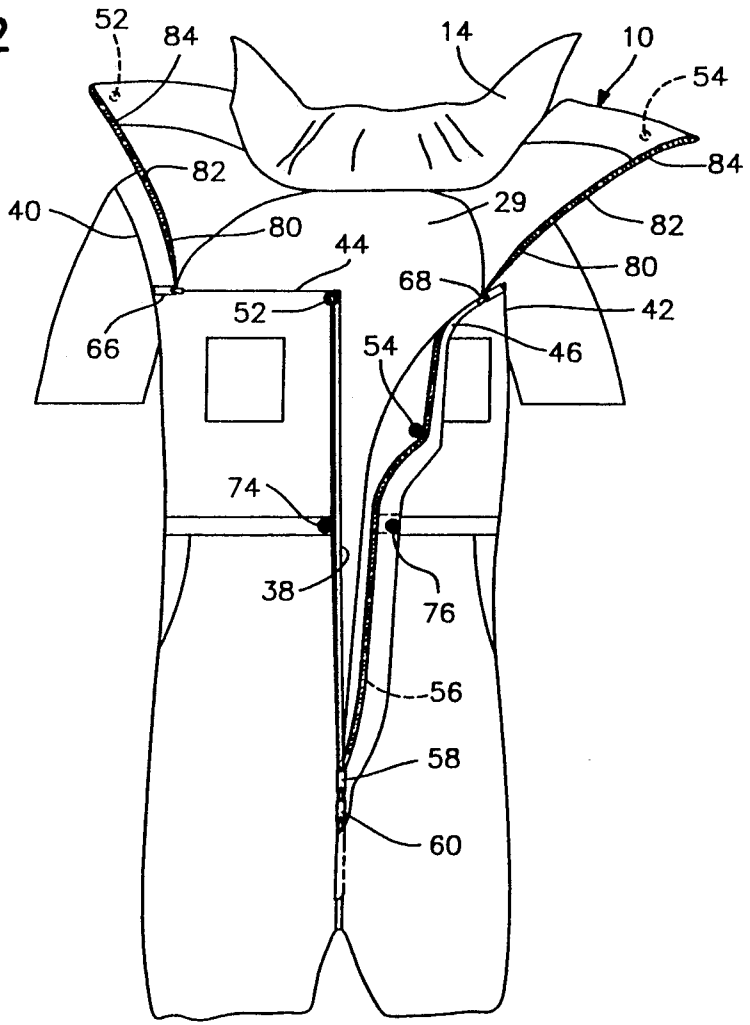
FIG. 2 is a front elevational view of the upper three quarters of the jumpsuit and/or coverall with the center and horizontal opposite side chest area openings fully opened and the upper portions of the front side of the jumpsuit and/or coverall spaced above the horizontal upper chest openings folded upwardly.

Referring now more specifically to the drawings the numeral 10 generally designates the jumpsuit and/or coverall garment of the instant invention incorporating a crotch portion 12, a collar portion 14, shoulder portions 16 and 18 on opposite sides of the collar portion 14, sleeve portions 20 and 22 extending downwardly and outwardly from the shoulder portions 16 and 18 and leg portions 24 and 26 which extend downwardly from opposite sides of the crotch portion 12. Further, the garment 10 includes a front portion 28 extending vertically between the crotch and collar portions 12 and 14 as well as a back portion 29.

From FIG. 2 of the drawings it may be understood that the front and back portions 28 and 29 are interconnected by the portions 12, 14, 16, 18, 20, 22, 24 and 26. Furthermore, the garment 10 defines a waist area 32 above and below which upper and lower portions 34 and 36 of the front portion 28 are disposed.

The front portion 28 defines a vertical central opening 38 extending downward from the collar portion 14 toward the crotch portion 12 and the upper end of the central opening 38 opens upwardly through the collar portion 14.

The sleeve portions 20 and 22 are joined to the shoulder portions 16 and 18 and opposite sides of the upper portion 34 of the front portion 28 along vertically extending stitching zones 40 and 42 and the upper portion 34 of the front portion 28 further includes a pair of generally straight, horizontal opposite side upper chest openings 44 and 46. The outer ends of the openings 44 and 46 terminate closely adjacent the stitching zones 40 and 42 at points spaced substantially two thirds downwardly along the stitching zones 40 and 42. The adjacent ends of the openings 44 and 46 open into the center opening 38 at approximately a mid-height portion 50 of the upper portion 34 of the front panel 28.

Immediately above and below the juncture of the openings 44 and 46 with the opening 48 opposite side portions of the upper portion 34 include coacting spot fastener means 52 and 54 for removably closing the opening 38 at those points and the lower portion of the central opening 38 disposed below the lower pair of spot fastener means 52 and 54 is closable by a slide fastener structure 56 extending longitudinally therealong. The slide fastener 56 includes a pair of slide fastener elements 58 and 60 whereby the portion of the opening 38 below the slide fastener means 52 and 54 may be opened downwardly from the top as well as upwardly from the bottom.

The openings 44 and 46 also have slide fastener structures 62 and 64 and the slide fastener structure 62 and 64 include slide fastener elements 66 and 68 which are moved outwardly and inwardly along the openings 44 and 46 to open and close, respectively, the openings 44 and 46.

Figure 3:
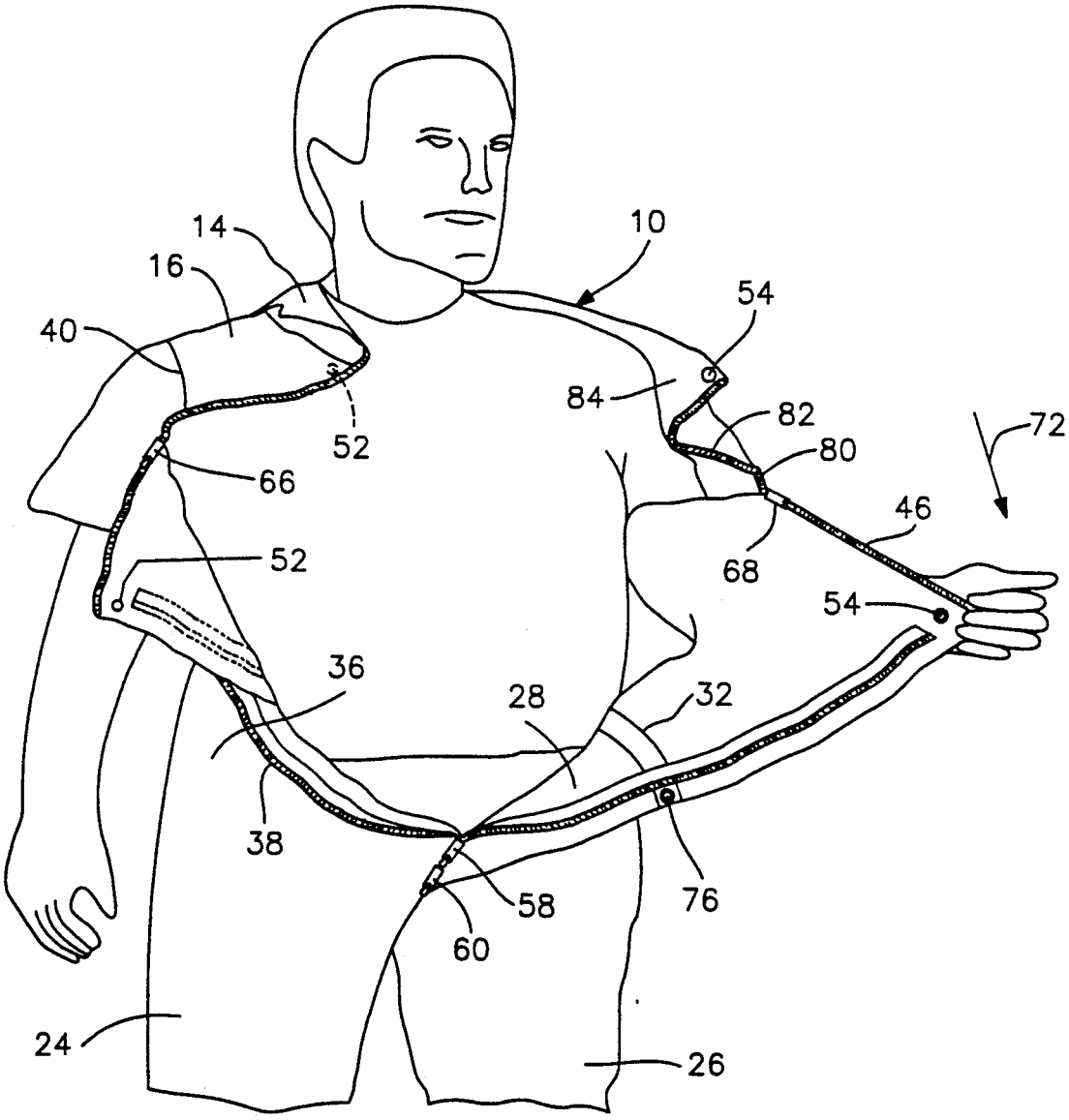
FIG. 3 is a perspective view with the jumpsuit and/or coverall being worn and the center and horizontal opposite side chest area openings fully opened and the wearer preparing to pull the left shoulder area of the jumpsuit from his left shoulder area.

The garment 10 has been specifically designed to enable the garment to be more readily donned and removed, both while seated and standing. In order to accomplish this desirable trait, and also to enable the spot fastener means 52, 54 to be released, the upper slide fastener element 58 is moved downwardly in order to open the central opening 38 somewhat thereafter, the slide fastener elements 66 and 68 are slid outwardly toward their limits of movement adjacent the stitching zones 40 and 42 and the fastener means 52, 54 are released from each other. At this point, the opposite side portions of the upper portion 34 of the front from which the upper pair of fastener means 52, 54 are supported may be folded upwardly and outwardly to the positions thereof illustrated in FIG. 3 and the opposite side portions of the lower half of the upper portion 34 are swung outwardly and downwardly as illustrated in the right hand portion of FIG. 2.

This will open substantially the full chest area of the wearer of the garment 10 if the wearer desires to cool down slightly while indoors and in a seated position.

Inasmuch as the outer limits of the openings 44 and 46 are substantially two thirds of the distance down the stitching zones 40 and 42 from the upper limits of the shoulders 16 and 18, an appreciable, but not extensive, portion of the outer shoulder portions 16 and 18 remain draped over the outer shoulder portions of the wearer in order to maintain the outer shoulder portions of the garment 10 over the shoulders of the wearer, even if the wearer is seated and carries out extensive arm movements.

This is important because the garment may be worn, in many instances, by person who may repeatedly move between indoor and outdoor locations during cool weather and for comfort sake it is desirable to open the upper part of the garment 10 when the wearer is inside a heated area, particularly if the garment is of the type insulated against cold weather.

In addition, jumpsuits and coveralls are favored by older persons who may be arthritic to some extent and by terminating the openings 44 and 46 at the stitch zones 40 and 42 substantially two thirds the distance down from the upper limits thereof, an arthritic person is assured that the upper portion of the garment 10 may be maintained over the outer limits of the shoulders to thus eliminate difficult arm movements in reapplying the upper outer shoulder portions of the garment over the wearer's shoulders due to otherwise possible slippage of the outer upper shoulder portions of the garment from the user's shoulders.

Further, inasmuch as the openings 44 and 46 terminate substantially two thirds the distance downwardly along the stitching zones 40 and 42 from the upper limits thereof, little intentional effort is required by the wearer to slip his shoulders out of the aforementioned outer shoulder areas of the garment 10, even when the wearer is seated. Accordingly, should the wearer enter a heated building from the exterior thereof in cool weather and wish to be seated at a desk while making a telephone call or performing other inside duties while seated, the spot fastener means 52, 54 may be disengaged from each other, the slide fastener 58 may be moved downward toward the waist area 32 and slide fastener elements 66 and 68 may be moved toward their outer limit positions. Thereafter, even while the wearer is seated, the entire upper portion of the garment 10 may be removed with little effort, even by arthritic persons. With attention invited more specifically to FIG. 3, it may be seen that a slight outward and downward pull in the direction of the arrow 72 in FIG. 3 while the slide fasteners 50 and 68 are in their full open positions is sufficient to easily cause the outer shoulder portions of the garment 10 to slip from the shoulders of the wearer. Of course, such slight outward and downward pull may be exerted on both areas of the garment 10 adjacent the lower fastening means 52, 54. These slight outward and downward pulls 72 may be exerted by the wearer while either seated or standing in order to achieve the desired result.

On the other hand, when it is desired for an arthritic person to don the garment 10, the openings 38, 44 and 46 are fully opened and the person steps into the leg portions 24 and 26 of the garment 10 while grasping the latter closely adjacent the opening 38 at the waist area 32. Once the lower portion of the garment 10 has been pulled upward such that the crotch portion 12 is in proper position, the slide fastener element 66 is raised to the waist area and the spot fastener means 74, 76 may be engaged with each other if desired.

Figure 1:
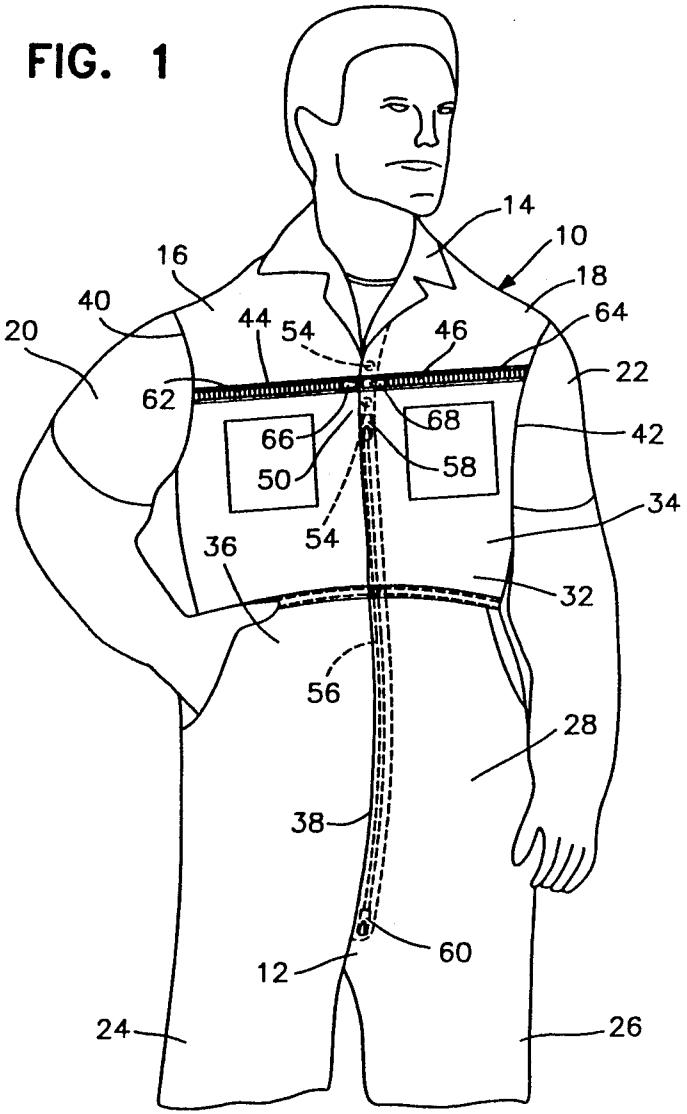
FIG. 1 is a front perspective view of the upper three quarters of a jumpsuit and/or coverall constructed in accordance with the present invention and illustrated donned by an individual with the opposite side horizontal openings of the upper chest portion of the front of the jumpsuit and/or coverall being closed as well the center vertical opening being closed.

At this point, the upper portion of the garment above the waist area 32 is draped downwardly to the extent such that the entrances to the sleeve portions 22 are substantially nine inches below the finger tip level of the person donning the garment 10 when his arms and hands are fully relaxed downwardly along his sides. Accordingly, the hands need be raised only about nine inches in order to be thereafter downwardly inserted into the openings of the sleeve portions 20 and 22. At this point, the wearer may swing his lower arms, only, upwardly and outwardly to his opposite sides in order that the sleeve portions 20 and 22 will move upwardly along his arms and the outer limits of the openings 62 and 64 will be disposed at the inner sides of the joints between his upper and lower arm portions. Thereafter, raising the arms and the upper arm portions, to positions with the arms disposed generally horizontally outward to the opposite sides of the person donning the garment 10 will slide the upper outer shoulder portions of the garment 10 to positions disposed at the outer limits of the person's shoulders. Then, successive inward pulling of the portions 80, 82 and 84 on the upper sides of the openings 44 and 46 will result in the areas of the garment 10 from which the upper fastening means 52 and 54 are supported being brought substantially into the positions thereof illustrated in FIG. 1 and the upper fastening means 52 and 54 may be engaged with each other. Thereafter, the slide fastener 58 may be moved to its upper limit position and the person donning the garment 10 then may use his left hand to pull the slide fastener 66 to the position thereof illustrated in FIG. 1 and his right hand to pull the slide fastener 68 to the position thereof illustrated in FIG. 1, each of which movements requires only that the person donning the garment 10 move each hand over to approximately the opposite armpit area, grasping the corresponding slide fastener elements 66 or 68 and pulling the latter toward the center opening 38.

These movements may be readily carried out by even arthritic persons with considerable ease. Accordingly, the garment 10 may be readily donned, removed or have the upper portion thereof opened or closed by arthritic persons with relative ease of movement.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalence may be resorted to, falling within the scope of the invention.

What is claimed as new and is as follows:

1. A unitary garment for enclosing the torso and at least the upper arm and legs of the wearer and having a crotch portion, a collar portion, shoulder portions on opposite sides of said collar portion and from which sleeve portions project outwardly and downwardly and a front portion extending between said crotch and shoulder portions and interconnecting said sleeve, shoulder and leg portions, said front portion defining a waist area thereof and upper and lower portions above and below, respectively, said waist area and further defining a vertical central opening therein having upper and lower ends and extending downwardly from said collar portion toward said crotch portion, said central opening opening upwardly through said collar portion, first slide fastener means operative to close said central opening from said lower end upwardly to a mid-height portion of said upper portion spaced downwardly from said upper end, said sleeve portions being joined to said front portion along vertical opposite side zones of said front portion extending downwardly from said shoulder portions to a level spaced appreciably below said mid-height portion, said upper front portion defining generally horizontal opposite side openings having outer ends closely adjacent the corresponding zones and inner ends opening into said central opening adjacent said mid-height portions, said outer ends of said opposite side openings being disposed substantially two thirds downwardly along said zones from the upper extremities thereof, and second and third slide fastener means releasably closing said opposite side openings.

2. The garment of claim 1 wherein said second and third slide fastener means each include a slide fastener element moveable along the corresponding opposite side opening and operative to close and open said corresponding opposite side opening responsive to movement of said slide fastener element inwardly and outwardly, respectively, along said corresponding opening.

3. The garment of claim 2 wherein said inner ends of said horizontal openings open into said central opening at a point spaced above said slide fastener means, and upper and lower spot fastener means closing said central opening above and below said horizontal openings, respectively.

4. A unitary garment for enclosing the torso and at least the upper arm and legs of the wearer and having a crotch portion, a collar portion, shoulder portions and on opposite sides of said collar portion and from which sleeve portions project outwardly and downwardly and a front portion extending between said crotch and shoulder portions and interconnecting said sleeve, shoulder and leg portions, said front portion defining a waist area thereof and upper and lower portions above and below, respectively, said waist area and further defining a vertical central opening therein having upper and lower ends and extending downwardly from said collar portion toward said crotch portion, said central opening opening upwardly through said collar portion, first slide fastener means operative to close said central opening from said lower end upwardly to a mid-height portion of said upper portion spaced downwardly from said upper end and upwardly from said waist area, first and second spot fastener means operative to close said central opening at a first location immediately above said mid-height portion and a second location spaced above said first location, respectively, said sleeve portions being joined to said front portion along vertical opposite side zones of said front portion extending downwardly from said shoulder portions to a level spaced appreciably below said mid-height portion, said upper front portion defining generally horizontal opposite side openings having outer ends closely adjacent the corresponding zones and inner ends opening into said central opening adjacent said mid-height portion between said first and second locations, said outer ends of said opposite side openings being disposed substantially two thirds downwardly along said zones from the upper extremities thereof, and second and third slide fastener means releasably closing said opposite side openings.

* * * * *